US008796945B2

(12) United States Patent
Zhai et al.

(10) Patent No.: US 8,796,945 B2
(45) Date of Patent: Aug. 5, 2014

(54) BALLAST AND BALLAST CONTROL METHOD AND APPARATUS, FOR EXAMPLE ANTI-ARCING CONTROL FOR ELECTRONIC BALLAST

(75) Inventors: Ning Zhai, Beijing Youth (CN); Xingwei Hu, Tai An Town (CN)

(73) Assignee: Fulham Company Limited, Hong Kong (HK)

( * ) Notice: Subject to any disclaimer, the term of this patent is extended or adjusted under 35 U.S.C. 154(b) by 966 days.

(21) Appl. No.: 12/305,367

(22) PCT Filed: Jun. 29, 2006

(86) PCT No.: PCT/CN2006/001496

§ 371 (c)(1),
(2), (4) Date: Mar. 31, 2010

(87) PCT Pub. No.: WO2008/014632

PCT Pub. Date: Feb. 7, 2008

(65) Prior Publication Data

US 2010/0213866 A1 Aug. 26, 2010

(51) Int. Cl.
*H05B 41/36* (2006.01)

(52) U.S. Cl.
USPC ..... 315/291

(58) Field of Classification Search
USPC ..... 315/291, 307, 32, 112, 117, 118, 315/DIG. 2, DIG. 4, DIG. 5
See application file for complete search history.

(56) References Cited

U.S. PATENT DOCUMENTS 5,519,289 A 5/1996 Katyl et al.
5,539,281 A * 7/1996 Shackle et al. ..... 315/224
6,008,589 A 12/1999 Deng
6,204,613 B1 3/2001 Hesterman
6,262,565 B1 7/2001 Williams et al.
6,274,987 B1 * 8/2001 Burke ..... 315/307
6,697,265 B2 2/2004 Drummond et al.

(Continued)

FOREIGN PATENT DOCUMENTS

CN 1547686 11/2004
WO WO 02/09479 1/2002

OTHER PUBLICATIONS

Sandrini, F. et al., ST Microelectronics, AN993 Application Note, Electronic Ballast with PFC Using L6574 and L6561, 2004, pp. 1-20.

(Continued)

*Primary Examiner* — Minh D A

(74) *Attorney, Agent, or Firm* — Henricks, Slavin & Holmes LLP

(57) ABSTRACT

A technique for providing control for an electronic ballast by responding to the current in the common bus (DC power rail) between a boost circuit such as a power factor circuit (PFC) and an output (such as a high frequency (HF) inverter) circuit, and adjusting, changing or shutting down either the power factor control circuit or the inverter circuit when the power going into the inverter circuit is above a threshold. Power going into the inverter circuit may be measured by a resistor, and temperature compensation may be provided. Excess power indicative of a spark is detected in such a way that normal starting of a lamp load connected to the ballast occurs without triggering the change/shutdown but an external arc will trigger the change/shutdown. For example, the output circuit may be shut down and the external arc curtailed within 200 msecs.

27 Claims, 3 Drawing Sheets

(56) References Cited

U.S. PATENT DOCUMENTS

| | | | | |
|---|---|---|---|---|
| 6,727,661 | B2 * | 4/2004 | Kominami et al. | 315/209 R |
| 6,756,771 | B1 * | 6/2004 | Ball et al. | 323/222 |
| 6,781,326 | B2 * | 8/2004 | Stack | 315/291 |
| 6,900,599 | B2 | 5/2005 | Ribarich | |
| 6,984,943 | B2 * | 1/2006 | Ono et al. | 315/291 |
| 7,015,652 | B2 | 3/2006 | Shi | |
| 7,307,386 | B2 * | 12/2007 | Fishbein et al. | 315/226 |
| 2003/0117084 | A1 | 6/2003 | Stack | |
| 2004/0257005 | A1 | 12/2004 | Poehlman et al. | |
| 2005/0029966 | A1 | 2/2005 | Buonocunto | |
| 2005/0168171 | A1 | 8/2005 | Poehlman | |

OTHER PUBLICATIONS

Dal Santo, I., et al., ST Electronics, AN991 Application Note, L6569-L6561 Lighting Application with PFC, Jun. 2002, pp. 1-3.

ST Electronics, L6561 Power Factor Corrector, Apr. 1999, pp. 1-11.

International Rectifier, Reference Design IRPLDIM1E/U, IR21592 Dimming Ballast Control IC Design Kit, www.irf.com, pp. 1-15.

Yang, Bo, LLC Resonant Converter, www.scholar.lib.vt.edu/ theses/ available/etd-09152003-180228/unrestricted/Ch4.pdf, pp. 94-141.

* cited by examiner

BALLAST AND BALLAST CONTROL METHOD AND APPARATUS, FOR EXAMPLE ANTI-ARCING CONTROL FOR ELECTRONIC BALLAST

CROSS REFERENCE TO RELATED APPLICATIONS

This application is a National Stage of International Application No. PCT/CN2006/001496, filed Jun. 29, 2006.

FIELD OF THE INVENTION

These inventions relate to apparatus and methods for operating ballasts, for example electronic ballasts such as those used to drive fluorescent lamps.

BACKGROUND OF THE INVENTION

Electronic ballasts are widely used to power lighting circuits, including conventional fluorescent lamps, compact fluorescent lamps, and other fluorescent lighting components. Ballasts have been classified as magnetic ballasts and electronic ballasts, and with electronic ballasts various solid-state electronics are used to replace one or more magnetic components in the magnetic ballasts. The electronic ballasts can operate at a higher frequency, making fluorescent lamp operation more efficient, and more cost-effective.

Ballasts are intended to be constant current devices so that, once a fluorescent lamp is started and is illuminated, the lamp sees a constant supply of current regardless of the value of the voltage represented by the lamp. It will be understood that the discussion herein will refer to a single or dual lamp combination, but a ballast can be designed to drive more than two lamps at a time. However, for simplicity of the present discussion, a ballast will be described as driving a generic load, which may be a single lamp or a pair of lamps or other combination of lamps. For any given load, the voltage presented by the load to the ballast over time may change, either slowly or quickly. For example, as a lamp ages, the voltage presented by the lamp to the ballast increases while the ballast continues to supply the same amount of current. Consequently, the power dissipated through the lamp increases. This change may be gradual over a matter of weeks, months or years. In some situations, lamp aging might be accelerated with frequent cold starts of the lamp, particularly at relatively high voltages and using instant start ballasts that do not preheat the fluorescent lamp filament before full starting. Rapid start ballasts pre-heat the fluorescent lamp filament and then apply a high voltage to start the lamp.

Another condition that may lead to high power dissipation may include poor connections or corroded terminals on the lamp or a connector. As the quality of the connection deteriorates, the voltage presented to the ballast by the load increases, resulting in higher power dissipation. In some situations where a connection is poor or nonexistent, for example where a lamp comes loose from its socket or other connection and there is an air gap between terminals, the high voltage being produced by the ballast at the constant current may produce an arc through the air. The arc can produce high temperatures, melting wire insulation, wires, adjacent plastic components such as sockets, housings and other equipment or possibly start fires.

Some electronic ballasts have power factor correction while others do not. In some ballasts, passive power factor correction can be accomplished using a large inductor in series with the power line input. Active power factor correction can be applied in other ballasts using a boost circuit. In other ballasts having no power factor correction, the ballasts are generally considered to have normal power factor. General examples of ballasts are shown in U.S. Pat. No. 6,008,589, incorporated herein by reference.

SUMMARY OF THE INVENTION

In one example of a system described herein, a ballast includes an input circuit and an output circuit, for example where the output circuit is used to drive a load, for example a fluorescent lamp. A sensing and control circuit placed at an input to the output circuit provides an indication of the magnitude or other characteristic of the power being input to the output circuit. For example, the sensing and control circuit can sense the magnitude of a current flowing into the output circuit, or it can sense some characteristic of the power being input to the output circuit. If the input to the output circuit changes according to a predetermined criterion, such as rising above a selected threshold or remaining above a selected threshold for a predetermined amount of time, the sensing and control circuit can cause adjustment in the signal being input to the output circuit. For example, the sensing and control circuit can reduce or eliminate the current signal being applied to the input of the output circuit, for example until the signal can be applied to the output circuit without rising above the selected threshold or until the system is manually reset or otherwise reconfigured or a problem corrected. In one configuration, the input circuit includes an AC input circuit and the output circuit is an inverter circuit. The inverter circuit can be any conventional inverter circuit such as those used for ballasts in typical fluorescent lamp ballasts. The sensing and control circuit can include a compensation component, such as a delay component and/or can also include a temperature compensation component. The delay component can compensate for the possibility of short-term transient conditions as to which the sensing and control circuit will take no action, and a temperature compensation component can compensate for temperature variations in the environment surrounding the sensing and control circuit. The sensing and control circuit can be used to adjust or change the input to the inverter circuit, or it can be used to change the operation of the inverter circuit. In one example, the input to the inverter circuit can be changed by changing a power factor correction circuit upstream from the inverter circuit. In another example, the inverter circuit can be changed to change the frequency of the high frequency signal developed by the inverter. In a further example, the output of the inverter can be reduced or eliminated by diverting or eliminating one or more signals from the inverter circuit.

In another example of a system described herein, a ballast circuit includes an input circuit, a boost circuit coupled to the input circuit and an inverter circuit for driving a load. The sensing circuit includes an output coupled to the boost circuit for changing the boost circuit. For example, the sensing circuit changes the boost circuit by reducing an output of the boost circuit as a function of a characteristic of an input to the inverter circuit. In one example, the boost circuit is a power factor correction circuit, and in another example, the boost circuit is a power factor correction circuit having a power factor correction control circuit which is triggered when the sensing circuit senses that the power input to the inverter has changed in a predetermined way. For example, where the current to the inverter has increased above a predetermined level, for example for a predetermined time, the sensing circuit applies a signal to the power factor correction control circuit to adjust or turn off the power factor correction. The inverter circuits can include any conventional inverter circuit, such as parallel resonant circuits, series resonant circuits, and the like.

In a further example of a system described herein, a ballast circuit includes an input, a boost circuit coupled to the input and an inverter circuit for driving a load. A sensing circuit is coupled between the boost circuit and the inverter circuit, and may be used to monitor the power or other characteristic of a signal being applied to the inverter circuit. The sensing circuit may then be used to change, reduce or turn off the output of the inverter circuit, for example by changing or turning off the boost circuit or by operating a feature that changes or turns off the inverter circuit. The sensing circuit can be coupled to a power supply line between the boost circuit and the inverter circuit, for example through a series connection, a transformer, inductive coupling, an active circuit or a number of impedance-type devices. In one configuration, the sensing circuit senses the magnitude of the current input to the inverter circuit. The magnitude of the current can be sensed through a current-sensing resistor. The sensing circuit can include a compensation device, such as a delay device or a temperature compensation device.

In an additional example of a system described herein, a ballast circuit having an AC input includes an inverter circuit having an input for receiving electric current and an output for driving a load, such as a fluorescent lamp. The boost circuit between the input and the inverter circuit is adjusted or triggered off by a sensing circuit monitoring the current into the inverter when the current is determined by the sensing circuit to have a predetermined characteristic, for example a high current amplitude. The sensing circuit can be configured to change the ballast circuit as desired, such as when the current input to the inverter reaches a predetermined magnitude for a predetermined time interval. In one example, the sensing circuit changes the ballast circuit by triggering the boost circuit, after which the boost circuit becomes in-active or turns off. The current into the inverter thereafter decreases, typically to a level below that at which the sensing circuit changed the ballast configuration. In one configuration, the sensing circuit can include a delay device, for example a capacitor, and/or a temperature compensation device such as a negative temperature coefficient resistor.

In another example described herein, a method for controlling a ballast is described. A current signal is applied to an inverter for producing a high frequency AC signal. A characteristic of the current signal applied to the inverter is sensed and the current signal applied to the inverter is changed when a characteristic of that current signal changes in a predetermined way. For example, the magnitude of the current signal into the inverter maybe reduced if the magnitude of the current signal rises above a predetermined magnitude. Alternatively, when the characteristic of current signal applied to the inverter changes in the predetermined way, a characteristic of or the operation of the inverter is changed, for example to change the output of the inverter. In one configuration, the current signal applied to the inverter is sensed after a predetermined delay, and in another configuration, the characteristic of the current signal is determined after taking into account environmental temperature changes. In another configuration, the characteristic of the current signal is sensed using a current-sensing resistor circuit.

In one example of a ballast, a circuit measures a DC power going into an inverter, and controls, adjusts or otherwise changes a ballast condition, for example to reduce the voltage applied to the load. In one example, the circuit shuts down or otherwise changes a power factor correction (PFC) circuit feeding the inverter when the power has changed too much, for example when the power is too high (above a threshold), has changed over too long of a time or has otherwise changed in a manner that is being monitored. In the example of a ballast using a power factor correction circuit, the PFC circuit is readily controllable, for example at a convenient high impedance level, and the measurement and control can be implemented at a relatively low cost. In one example of a measurement circuit, the circuit senses current in a common bus of the ballast, and when the threshold is reached, the PFC (or, alternatively, the inverter) is stopped or otherwise adjusted. Additionally, the adjustment can be held or maintained until such time as the threshold is no longer reached, after which the ballast can return to its original configuration immediately or, if desired, after a suitable delay or until the circuit is manually reset if a manual reset is desired.

In another example, a ballast can include an anti-arcing control circuit, which reduces the possibility that an electronic fluorescent ballast's output leads arc with lamp pins due to bad contact or generate arcing between exposed lamp pins. An anti-arcing control circuit is useful, for example, for instant start, parallel output gas discharge fluorescent electronic ballasts.

In a further example of a ballast, an electronic ballast comprises a power supply receiving AC voltage and outputting a DC voltage, a power factor control circuit receiving the DC voltage and outputting an output rail voltage (Vdc) on an output power rail, and an inverter circuit receiving the output rail voltage (Vdc) and having ballast output leads for connecting to a load comprising one or more fluorescent lamps. An anti-arcing circuit is connected in a power rail between the power factor control circuit and the inverter circuit, the anti-arcing circuit comprising means for measuring power going into the inverter circuit and for shutting down at least one of the power factor control circuit and the inverter circuit when the power going into the inverter circuit is above a threshold. The means for measuring power going into the inverter circuit may be a resistor connected between the power factor control circuit and the inverter circuit. The means for measuring power going into the inverter circuit alternatively may be a component selected from the group consisting of a diode, or the emitter base (eb) junction of a transistor, a sensing coil to magnetically couple, and an FET which has a built-in sensing resistor. Means for providing temperature compensation may be provided, for example for the measuring means, in the form of a negative temperature coefficient resistor, or an op amp.

In an additional example described herein, a method is described for providing external arcing protection for an electronic ballast and may include sensing current in a power rail feeding an output circuit of the electronic ballast, detecting excess power being drawn by an external arc, and when excess power indicative of an external arc is detected, adjusting, changing or shutting down the output circuit so that the external arc is reduced or cannot be sustained. In one example, the excess power is detected slowly enough, or monitored over a sufficiently long time, so that the normal starting of a lamp load connected to the ballast can take place without shutting down the output circuit, and the excess power is detected fast enough to curtail the external arc within a desired amount of time. For example, the output circuit may be shut down and the external arc curtailed within 200 msecs. The method may also comprise providing temperature compensation, if desired.

In a further example, apparatus for providing external arcing protection for an electronic ballast comprises means for sensing current in a power rail feeding an output circuit of the electronic ballast and means for detecting excess power being drawn by an external arc. Means for shutting down, reducing or limiting the output circuit may be included so that the external arc cannot be sustained when excess power indicative of an external arc is detected. Means for providing temperature compensation may be provided.

In another example, methods and apparatus are described for responding to current changes in a common bus, such as a power rail. This can be done with ballasts, including but not limited to series resonant or parallel resonant ballasts. A ballast having a boost circuit can be controlled, for example, by shutting down the boost because it is an easy way to control the power. Alternatively, it is possible to shut down the output inverter, for example if there is an output control chip like an L6574, it allows for shutting down a ballast output. Even if there is not an output control chip and the ballast is self-oscillating, oscillation can be shut down by triggering, for example, an SCR and using it to latch down a part of the feedback circuit to prevent further oscillation. These and other examples are set forth more fully below in conjunction with drawings, a brief description of which follows.

DETAILED DESCRIPTION OF THE PREFERRED EMBODIMENTS

Figure 1:
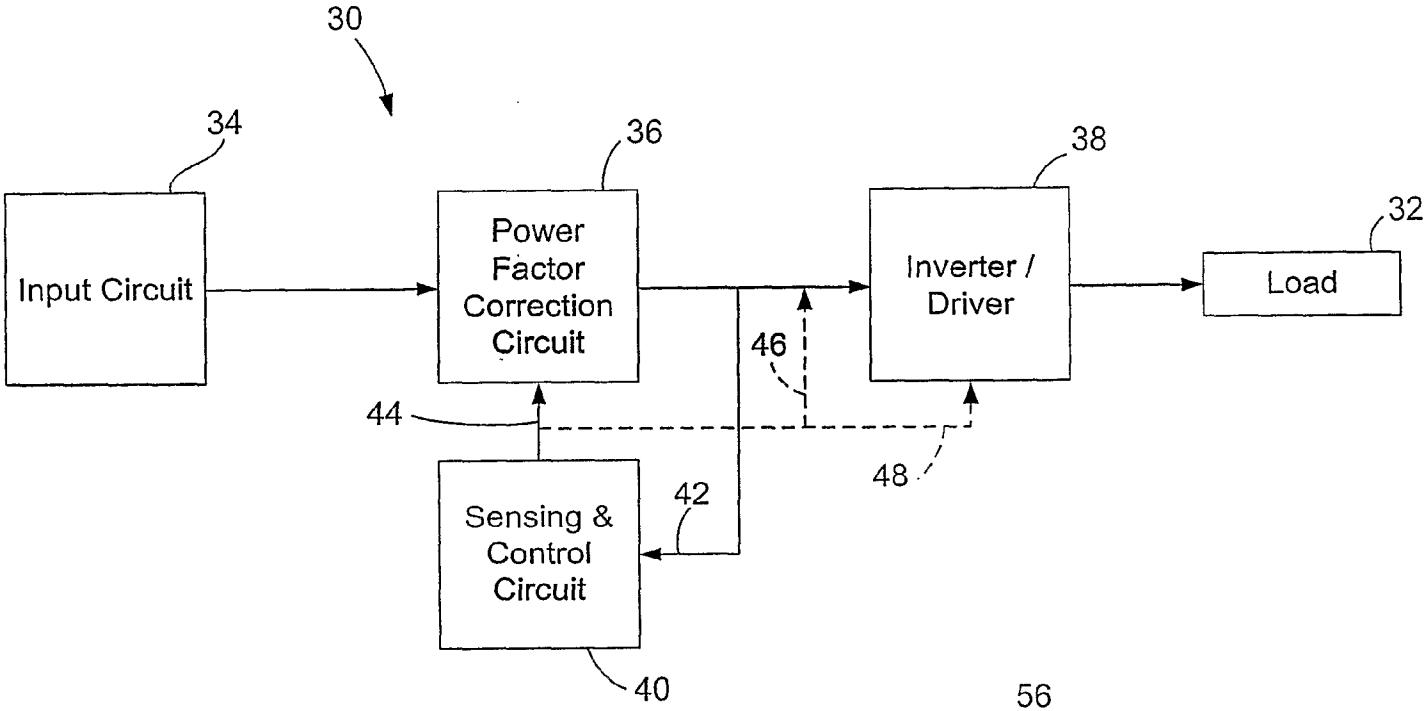
FIG. 1 is a schematic representation of a ballast circuit having a sensing and control circuit such as may be used to adjust the input to an inverter circuit or to adjust the inverter circuit itself.

This specification taken in conjunction with the drawings sets forth examples of apparatus and methods incorporating one or more aspects of the present inventions in such a manner that any person skilled in the art can make and use the inventions. The examples provide the best modes contemplated for carrying out the inventions, although it should be understood that various modifications can be accomplished within the parameters of the present inventions.

Examples of circuits and of methods of using the circuits are described. Depending on what feature or features are incorporated in a given structure or a given method, benefits can be achieved in the structure or the method. For example, circuits can use a relatively simple sensing and control system or combination that may more easily reduce component damage sometimes occurring with poor lamp or other load connections, such as arcing, without needing more expensive components. Such a system or combination may also be applied in several ways, at the option of the designer, to achieve the desired protection for the components. Additional benefits can be derived by including further protection from circuit variations over time, such as by reducing the effects of temperature variations on the sensing and control system or combination through a temperature compensation circuit. Additionally, the configurations described in the present examples are relatively simple and low cost, while still improving the protection against arcing and similar effects, and they can be applied to a number of ballast designs.

These and other benefits will become more apparent with consideration of the description of the examples herein. However, it should be understood that not all of the benefits or features discussed with respect to a particular example must be incorporated into a circuit, component or method in order to achieve one or more benefits contemplated by these examples. Additionally, it should be understood that features of the examples can be incorporated into a circuit, component or method to achieve some measure of a given benefit even though the benefit may not be optimal compared to other possible configurations. For example, one or more benefits may not be optimized for a given configuration in order to achieve cost reductions, efficiencies or for other reasons known to the person settling on a particular product configuration or method.

Examples of a number of circuit configurations and of methods of making and using the circuits are described herein, and some have particular benefits in being used together. However, even though these apparatus and methods are considered together at this point, there is no requirement that they be combined, used together, or that one component or method be used with any other component or method, or combination. Additionally, it will be understood that a given component or method could be combined with other structures or methods not expressly discussed herein while still achieving desirable results.

Electronic ballasts having boost circuits are used as examples of a lamp driving circuit that can incorporate one or more of the features and derive some of the benefits described herein, and in particular electronic ballasts having power factor correction circuits. Power factor correction circuits minimize the peak current drawn from the AC power line by a device, thus making most efficient use of the electric power grid. While a single configuration for a ballast will be described with respect to a lighting circuit, ballasts other than those using power factor correction can benefit from one or more of the present inventions. Moreover, while a single configuration of the sensing and control circuit or combination and how they are incorporated into a ballast are described in detail, it will be understood that other configurations can be used as well.

Normal starting for an instant start ballast occurs in less than 100 msecs (milliseconds). Ballasts can start in less than 30 msecs, and some in less than 10. When an arc occurs, extra power is drawn in the inverter, and it may be desirable to detect the extra power when it reaches about 8% or 10% extra power for triggering. Preferably, the 8% or 10% extra power is detected in about 200 msecs to be effective. Additionally, the configurations described herein can be modified in a number of ways so that an 8% or 10% trigger feature is deactivated or set to a higher or different level during starting to avoid "false triggers".

Generally, the conditions for an arc must first start before an arc can be detected, so references herein to "preventing" an arc will be understood to mean "detecting and stopping", or "curtailing" the arc. The terms "spark" and "arc" may be used interchangeably.

In one example of methods and apparatus described herein, a ballast circuit 30 or other circuit for driving a load 32 may include an alternating current or other input 34 (FIG. 1; the load 32 does not form part of the ballast). In the present examples described herein, it will be assumed that the AC input 34 receives alternating current input from normal power mains, supplying 120 volts, 240 volts or 277 volts at 50 or 60 Hz. However, if the AC input levels are significantly different from these, circuit component values can be adjusted in the design so that the ballast can easily accommodate different voltages other than these. However, the description herein assumes that the AC input conforms to one of the commonly available inputs, namely 120 volts, 240 volts or 277 volts at which most power systems are designed. Therefore, the present examples will be considered in the context of any of the foregoing examples, while it should be understood that other examples are possible.

In the present examples, the ballast includes a boost circuit such as a power factor correction circuit 36 coupled to the AC input. The power factor correction circuit receives a rectified DC signal from the input circuit. The boost circuit can take a number of configurations, but the example described herein is a power factor correction circuit, such as an L6561 Power Factor Corrector IC described more fully below. The output of the power factor correction circuit is applied to a conventional inverter or driver 38, the output of which is then applied to the load 32. The load 32 in the present examples will be taken to be a conventional fluorescent lamp, for example a fluorescent tube lamp, compact fluorescent lamp or other light source, but it should be understood that other loads can be driven by inverter/driver 38. An inverter can be a series resonant inverter, parallel resonant inverter, self resonating half bridges, driven inverters, and the like. Additionally, with a driven inverter, the frequency of the inverter can be adjusted by a sensing and control circuit for changing the inverter output, for example if arcing at the output is sensed.

The example represented by FIG. 1 also includes a sensing and control circuit 40. The sensing and control circuit 40 can take a number of configurations, but in the present examples it senses or monitors an input to the inverter 38, and it is configured to cause a change in the input to the inverter by applying an appropriate input to the power factor correction circuit 36, as represented in FIG. 1 by line 44, and as described in the examples herein. Alternatively, the sensing and control circuit can be configured to cause a change in the input to the inverter by applying a control signal directly to the inverter input, as represented by the dashed line 46, or it can be configured to cause a change in the inverter circuit 38 by applying a control signal to the inverter, as represented by the dashed line 48. An example of a direct control of the inverter circuit 38 includes triggering a crow bar circuit, or changing the operation of the inverter circuit such as by changing the frequency of its operation.

Figure 3:
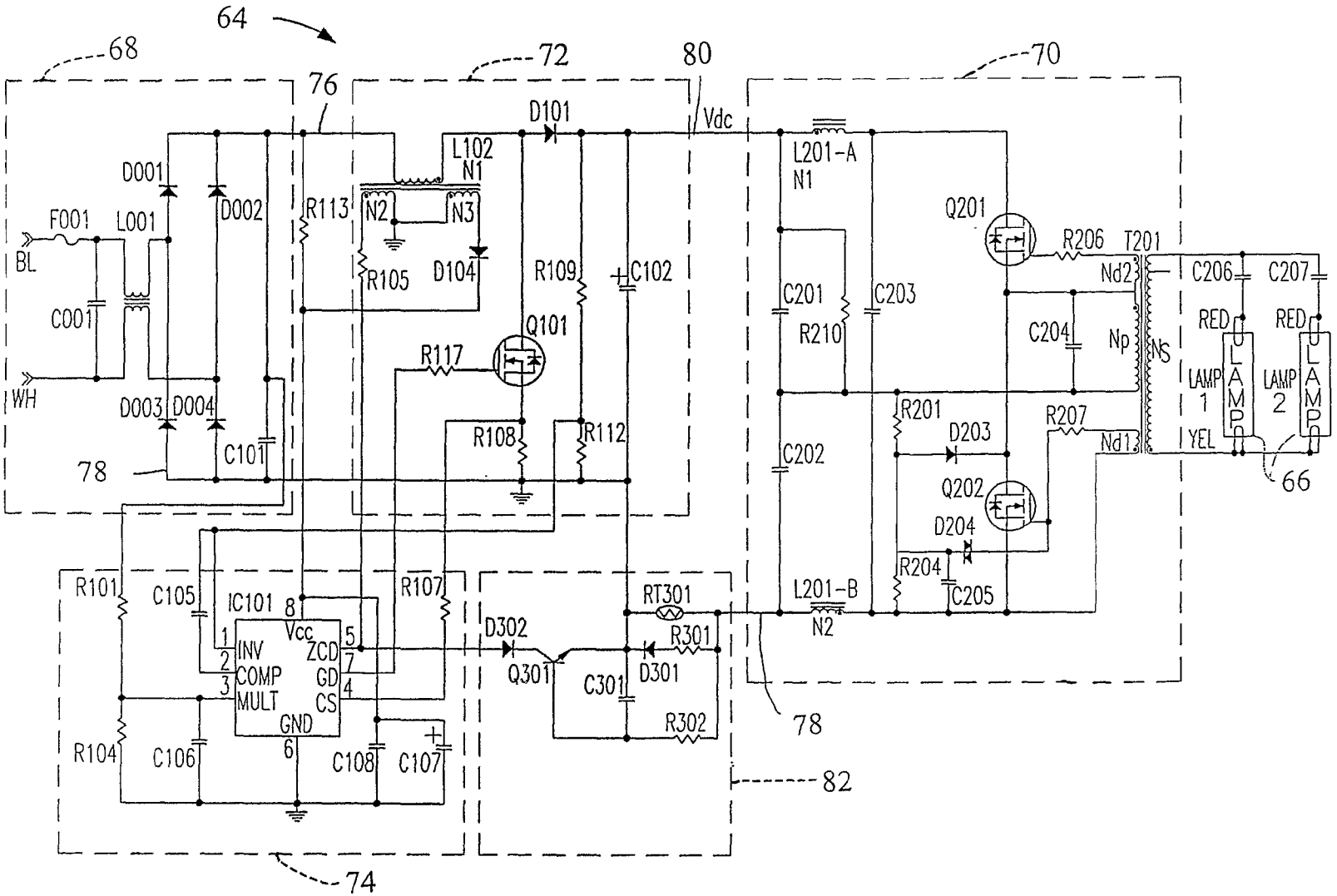
FIG. 3 is a detailed schematic of a ballast circuit according to one example described herein.

As will be shown in more detail with respect to FIG. 3, the sensing and control circuit 40 can be coupled to the input of the inverter 38 by being coupled directly in series in a main power line for the ballast between the power factor correction circuit 36 and the inverter 38. However, other means for coupling the sensing and control circuit 40 to the power input to the inverter 38 may include inductive coupling, a transformer, an active circuit or other impedance-type circuits. Additionally, as will be shown in more detail with respect to FIG. 3, the sensing and control circuit 40 senses or monitors the input to the inverter 38 by sensing the power input to the inverter. Specifically, the sensing and control circuit 40 senses the magnitude of the current into the inverter 38 through a current sensing resistor or resistor circuit in the sensing and control circuit 40. While other ways of sensing the magnitude or other characteristic of the power input to the inverter can be used, a current sensing resistor or resistor circuit is a suitable method for reliably sensing the magnitude of the current in the circuit. While other components are described below as being included in the sensing and control circuit 40 for providing reliable operation of the circuit 40, the current sensing resistor is the component that senses the magnitude of the current input to the inverter.

In the configuration of the circuit shown in FIG. 1, the sensing and control circuit includes the coupling 44 for applying a control signal or control input to the power factor correction circuit 36. When the sensing and control circuit 40 senses that a characteristic of the input to the inverter circuit has changed to a selected characteristic, for example a current magnitude being too high, the sensing and control circuit 40 applies a signal to an input of the power factor correction circuit 36. The sensing and control circuit 40 in one example turns off the power factor correction circuit when a magnitude of the current input to the inverter 38 is too high. In this configuration, the power factor correction circuit no longer operates while the input from the sensing and control circuit is applied to it, thereby adjusting or changing the input to the inverter 38. Consequently, power factor correction no longer occurs and the magnitude of the voltage available at the output of the inverter is significantly reduced. When the output voltage is reduced, the likelihood of arcing between a fluorescent lamp and its connection is also reduced.

Figure 4:
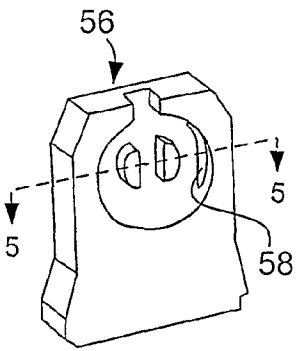
FIG. 4 is an isometric view of a type of connector for a bi-pin lamp such as may be coupled to the output of a ballast such as one described herein.
Figure 5:
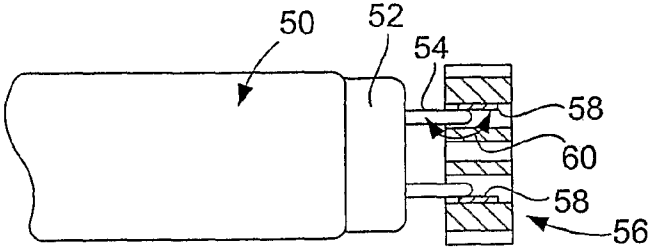
FIG. 5 is a transverse section of the connector of FIG. 4 and showing a partial cutaway view of a lamp coupled to the connector.

A lamp connection is represented in FIGS. 4 and 5, where a bi-pin lamp 50 includes a terminal assembly 52 having a pair of electrically conductive connection pins 54. The lamp 50 represents one form of fluorescent lamp, and other forms have other configurations. In the present example, the lamp 50 is connected to a ballast for driving the lamp through a socket 56 having connection terminals 58 corresponding to respective pins on the lamp. If the lamp or the socket is damaged, or if the connection is compromised such as by corrosion or physical damage, or if the lamp starts to become separated from the socket, there is a possibility of arcing when the ballast is operating to drive the lamp. If the junction between the socket and the lamp becomes compromised, and the ballast tries driving the lamp, the ballast may see a higher resistance resulting from the compromised lamp connection. With the typical voltage present at the terminals 58 of the socket, or with the voltage the ballast tries to apply with a compromised lamp connection, the possibility of arcing increases. For example, the high voltage between the terminal 58 and the lamp pin 54 may cause the surrounding air to become ionized, causing an arc as represented by the arrow 60. Arcing may also occur between the lamp pins if one end of the lamp is completely disconnected from its corresponding socket while the other end is being driven by the ballast. If arcing occurs, or if the resistance presented to the ballast by a compromised connection increases sufficiently, or if the lamp condition deteriorates sufficiently so that the ballast sees a higher resistance from load 32, the current and therefore the power input to the inverter 38 increases. With a higher current or power input to the inverter, the sensing and control circuit 40 will adjust or reduce the input to the inverter by adjusting or turning off the power factor correction circuit 36. The tendency for arcing can then be reduced or eliminated until such time as the condition at the load is corrected or improved.

Figure 2:
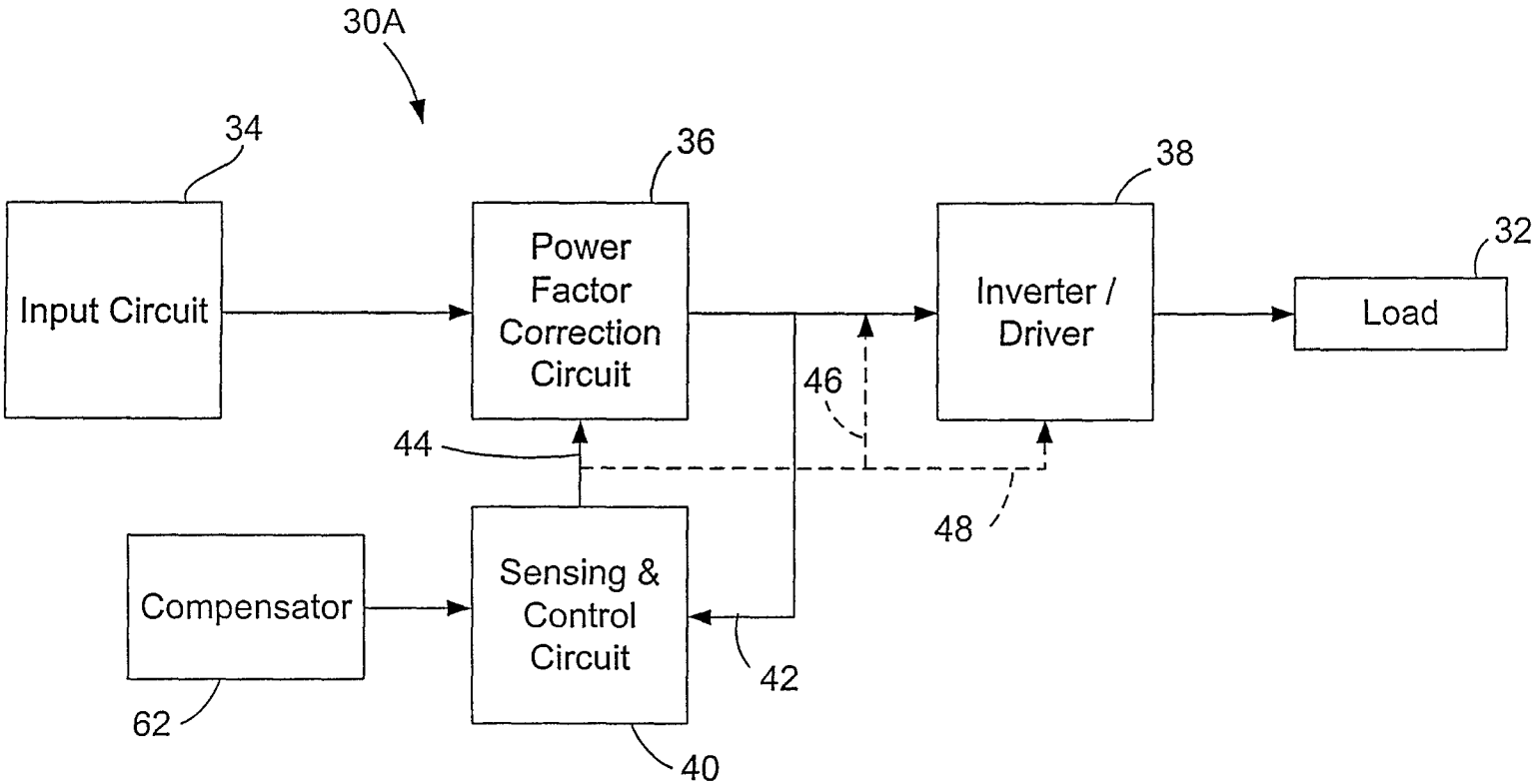
FIG. 2 is a schematic representation of another configuration of a ballast circuit having a sensing and control circuit with a compensation circuit.

In an alternative configuration of a ballast and a method for controlling a ballast, a circuit 30A (FIG. 2) may include all of the components/configurations and their alternatives discussed with respect to the circuit 30 shown in FIG. 1. In addition, the circuit 30A may include a compensator 62. The compensator 62 adjusts the sensing and control circuit 40 to compensate for variations in the environment or otherwise. For example, the compensator 62 may include a temperature compensation circuit that adjusts the sensing and control circuit 40 as a function of the temperature in the ballast. As a result, the sensing and control circuit can remain relatively immune from temperature fluctuations, especially for those circuit components in the sensing and control circuit 40 having a greater sensitivity to temperature. For example, the resistance of materials decreases with increased temperature, which means the current sensing resistor in the sensing and control circuit 40 may be affected by temperature fluctuations. The compensator 62 may be used to minimize the effect on the current sensing resistor of surrounding temperature fluctuations. Other forms of compensation may be used for reducing the effects of environmental changes or changes in the system over time.

Considering another example of a ballast circuit in more detail, a ballast circuit 64 (FIG. 3) is shown coupled to a pair of parallel-connected lamps 66 to be driven by the ballast. The lamps do not form part of the ballast, but they are shown to represent the load to be driven by the ballast, in this example a pair of lamps, lamp 1 and lamp 2. The ballast includes an input circuit 68 to be coupled to a conventional power source, such as from a utility or other power source. The ballast 64 also includes an inverter or driver circuit 70 having suitable output conductors to be coupled to the conductors of a lighting circuit, such as the terminals 58 in the lamp socket 56 (FIG. 4). In other lighting system configurations, the ballast circuit can be hard-wired to the lighting unit or units, or coupled to the lighting system in known configurations.

In this specific example of the ballast 64, the ballast includes a power factor correction circuit, in this example an active power factor correction circuit having a main power factor correction circuit 72 and a power factor correction control circuit 74. As in conventional ballasts having power factor correction, the power factor correction circuit 72 increases the power factor of the ballast, and serves as a boost circuit between the input circuit 68 and the inverter circuit 70. The circuit 72 is controlled by the power factor control circuit 74. In the present example, the two circuits 72 and 74 form the power factor correction circuit for the ballast.

The input circuit 68 includes input conductors for receiving AC voltage input on a hot and neutral with a fuse F001 to provide protection against a catastrophic short circuit failure inside the ballast. A capacitor C001 spans the hot and neutral before the inductor L001. The output of the inductor L001 provides input to a conventional full wave bridge rectifier circuit composed of diodes D001-D004. The full wave rectifier bridge produces a rectified current signal on the rectifier output rail 76 and on the common bus 78, or the return DC bus at approximately 170 volts.

The rectified current signal is applied to the power factor correction circuit 72, which produces a boosted output voltage Vdc on the output rail 80. The output voltage is applied to one side of the inverter circuit 70, the other side of which is coupled to the common bus 78. Power factor correction is controlled by the integrated circuit IC101 in the control circuit 74. The integrated circuit IC101 may be the IC number L6561 available from STMicroelectronics or a similar circuit. The components of the power factor correction main circuit 72 and the power factor correction control circuit 74 are arranged and coupled together in a manner similar to that described in Application Note AN991, incorporated herein by reference.

The inverter circuit 70 is a parallel resonant inverter circuit receiving output voltage Vdc and converting it to a high frequency output for driving the lamp or lamps representing the load for the ballast. The inverter can also be a series resonant circuit, series parallel resonant circuit, class E resonant circuit or other ballast circuits.

The ballast circuit 64 also includes a sensing and control circuit 82. The sensing and control circuit reduces or eliminates the possibility of arcing, or at least of sustained arcing, depending on the values of components incorporated in the circuit 82. In the example shown in FIG. 3, the sensing and control circuit 82 is coupled between the power factor correction circuit 72 and the inverter circuit 70, and provides an input, trigger, pulse or grounding signal to the power factor correction control 74. The sensing and control circuit 82 is coupled between the power factor correction circuit 72 and the inverter 70 by being coupled in series with the common bus 78 between the power factor correction circuit 72 and the inverter 70. The sensing and control circuit 82 can be coupled at other locations in the ballast circuit, for example on the high voltage input 80 to the inverter (in which case the polarities would be reversed and a voltage shifting element would be used to down-shift the voltage level from that of the high voltage input 80 on the inverter to the lower voltage level for the IC101). Additionally, the mode of coupling the sensing and control circuit to a portion of the ballast circuit can also take other configurations. For example, the sensing and control circuit 82 can be coupled in the ballast circuit by a transformer, inductive coupling, other reactive circuits, or the like.

While the sensing and control circuit 82 is shown in FIG. 3 as a number of components forming a functional unit within the dotted line identified as 82, it should be understood that the sensing functions and its components can be differentiated or separated from the control functions and components without detracting from the operation and functions of the circuit. The structures and functions of the various components in the sensing and control circuit 82 will be understood more fully from the discussion below.

The sensing function of the sensing and control circuit 82 is accomplished by a current sensing resistor R301, having one side coupled to the common bus in common with one side of the capacitor C202 and inductor L201-B in inverter circuit 70. The other side of the current sensing resistor R301 is coupled to the common bus on the power factor correction main circuit 72 side through a Schottky diode D301 as shown in FIG. 3. The anode of the diode D301 is coupled to the current sensing resistor R301. In this example, the sensing resistor R301 can be used to sense high voltage and therefore high-power drain conditions such as arcing or end of lamp life, or other conditions which increase the current on the mains, or which increase the output voltage of the ballast. These conditions represent high power input into the inverter and drawn at the ballast output, and it is intended that the sensing portion of the circuit be able to sense those conditions. The sensing resistor R301 can then be used to trigger or control another portion of the circuit to reduce or turn off the ballast output or otherwise reduce or eliminate the potential for arcing or other adverse condition.

Other electronic components could be used to detect arcing or other conditions representing higher power draw. For example, a diode, or the emitter-base (eb) junction of a transistor, or a sensing coil to magnetically couple could serve a detection function. A FET which has a built-in sensing resistor could also be used for detecting the power in the bus.

A switching transistor Q301 is coupled to pin 5 of the power factor correction control circuit IC101 through a Schottky diode D302. When the switching transistor Q301 is turned on, the zero crossing detector and ZCD voltage is grounded or clamped or taken low to disable the control IC101 thereby turning off the power factor correction. In this way, the switching transistor Q301 can be used as a control element for controlling the operation of the power factor correction circuit or other components in the ballast. Turning off the power factor correction reduces the voltage output of the ballast, which reduces or eliminates the potential for arcing, while still allowing the rest of the circuit to operate normally but without the power factor correction. When the switching transistor Q301 stops conducting, the ZCD pin is released and the controller IC101 is re-started and power factor correction is returned to normal operation. While turning on the switching transistor Q301 turns off the power factor correction, activating the switching transistor Q301 can be used in other ways to reduce the voltage output of the ballast. For example, the switching transistor Q301 can be used to activate a crow bar circuit in the inverter, change the frequency of the inverter, short the gate of one of the inverter transistors, reduce the rail voltage, or otherwise reduce the output voltage of the ballast. Therefore, the sensing and control circuit 82 can selectively enable or disable one or more circuits in the ballast, or can attenuate the output of the inverter circuit 70.

The switching transistor Q301 is a low-power NPN bipolar transistor and has its collector emitter junction coupled to the cathodes of the diodes D302 and 0301, respectively, as shown.

The sensing and control circuit 82 can also include a delay circuit, such as one that delays or withholds the control signal for a predetermined period to reduce the possibility of triggering by transient signals or noise on the circuit. The sensing and control circuit 82 includes an RC circuit coupled across the resistor diode combination of R301 and D301. A resistor R302 is coupled at one end to the common bus 78 and at the other end to a capacitor C301, the other side of which is coupled between the cathode of the diode D301 and the emitter of the switching transistor Q301. The capacitor C301 is coupled across the emitter base junction of the switching transistor Q301. The RC delay circuit delays the triggering of the control portion of the sensing and control circuit 82, as discussed more fully below.

The sensing and control circuit 82 can also include a compensation circuit, such as to account for temperature variations that might otherwise affect the sensing function of the circuit. In the example shown in FIG. 3, the sensing and control circuit 82 includes a negative temperature coefficient resistor RT301 connected in parallel across the resistor diode combination of R301 and D301. The material and the resistance of the resistor RT301 is preferably chosen to produce effectively temperature-independent sensing in the sensing and control circuit 82. Other compensation functions can be incorporated into the sensing circuit as well. It is possible that the temperature compensation function could be achieved by using the diode D301 to compensate for temperature variations, or the diode in combination with the resistor RT301. The Schottky diode D301 forward voltage VD301 temperature coefficient is close to that of the switching transistor Q301 base-emitter working voltage (VBEQ301) temperature coefficient. Therefore, the diode D301 can compensate for temperature variations of VBEQ301. The diode D301 could also be a PN junction, an emitter-base junction of another transistor or another components responding to temperature in the desired way. In another alternative, an op amp can be used to sense voltage across the sensing transistor R301.

In the example shown in FIG. 3, the resistor R301 functions as an arcing sensing component. The voltage (VR301) developed across the resistor R301 is proportional to the high frequency inverter's input current (IINV) and input power (PINV), according to the following relationship:

$$VR301=IINV*R301=PINV*R301/Vdc.$$

Where Vdc is the output voltage of the boost. In the particular example of the circuit shown in FIG. 3, arcing can be detected when the sensing resistor R301 is a 1.5 ohm resistor, 0.3 Watts, under normal operating conditions, in combination with the resistor RT301, so that the voltage drop necessary to activate the control function of the circuit 82 is about 0.7 volts across the emitter-base junction of the switching transistor Q301. RT301 is selected to be about 15-30 ohms, so that R301 at 1.5 ohm is equal to about 5%-10% RT301. In the example circuit of FIG. 3, the resistor and other component values are selected so that the switching transistor Q301 is triggered when the voltage excursion (change in Vdc) sensed is about 8%-10% above normal for the ballast and lamp combination. That change may be as low as 5% voltage excursion, and may be between 10%-20% or more, and as high as 25% or 50% higher, but a voltage excursion lower than 30% is preferred and a range of 10%-20% is more preferred. Such a change would indicate that maintenance of the system is warranted, such as by replacing the bulb or checking and improving connections with the lamp, and the like. Other configurations are possible, given the description of the circuits and functions set forth herein, but having no more than the components R301, R302, D301, D302, C301 and Q301 or their equivalents make for an efficient sensing and control circuit.

In operation, as noted above, arcing or another anomaly is detected by the sensing resistor R301, which has a value of 1.5 ohm, 0.3 Watts, during normal operation. The resistor R302 provides a time constant in conjunction with the capacitor C301, thus determining the time for which a voltage across R301 has to persist before Q301 turns on. The current through R301 is conveying the entire DC power of the ballast, and will depend on the size of the ballast. The voltage drop needed to turn on Q301 is about 0.7V across the emitter-base junction of Q301. (The voltage control triggering circuit is a current sensing circuit comprising Q301 and R301, R302.)

The capacitor C301 will be charged up to 0.6V before the sensing circuit can trigger the switching transistor Q301, and the time constant for the RC circuit of R302 and C301 can be made long enough to avoid triggering the switching transistor Q301 when the ballast first starts. Once the capacitor is charged, it only takes a voltage excursion from 0.6V to 0.7V to trigger the switching transistor and trip the shut down of the power factor correction control circuit 74. The time constant of C301×R302 can conveniently be made equal to approximately 0.5 seconds which is sufficient to achieve the desired immunity to ballast starting and freedom from accidental tripping in response to environmental disturbances.

Because the small power NPN bipolar transistor Q301 derives its base drive from the relatively low impedance of R301 and its collector is driving the relatively high impedance of R105, then it will usually go into saturation when the base drive is thus energized. (The transistor Q301's collector-emitter saturation voltage is usually less than 0.3V.) The polarity of Q301 is simply a design choice. This embodiment works on the negative rail of Vdc, so NPN is appropriate. On the positive rail, a PNP transistor would be used.

Once an excursion is detected or sensed, and when switching transistor Q301 is saturated, the circuit 82 uses the small power Schottky diode D302 to clamp the voltage of cross-zero pin 5 (ZCD) of IC101, which makes the power factor correction circuit stop working or shut off, and therefore the DC rail voltage Vdc drops from 470V to 170V (for example), whereupon the high frequency oscillation inverter 70 does not have enough output voltage to support an arc (or other high power drain event) and any arcing stops. In other words, when a spark situation is detected, the external spark is curtailed by sharply reducing the DC rail voltage from the power factor control circuit to the high frequency inverter circuit.

When the arcing or other condition disappears or stops, the DC voltage (VR301) across the current sensing resistor R301 is reduced to the low level corresponding to open circuit operation. Once C301 has discharged, the transistor Q301 is no longer in saturation and the ZCD pin of the IC101 is no longer clamped. Therefore, the power factor correction starts to work again, and the rail voltage Vdc increases to the design voltage (e.g., 470V). At this time, the high frequency oscillation inverter again has its full output voltage capability, and if there is continuity in the lamp circuit, reignites the lamps.

If any arcing or other adverse condition at the lamp load occurs again, the sensing and control circuit will shut down the power factor correction control IC, IC101, and limit the high frequency oscillation inverter.

The condition of arcing circuit is given by the equation:

$$VBEQ301=VR301+VD301.$$

Normally the resistance of resistor R301 can be designed according the electronic ballast output power (Po), wherein Po is the normal output power, as indicated by the following equation:

$$R301=Vdc(VBEQ301-VD301)/((1.25\sim1.5)Po);$$

where Vdc is the link voltage indicated in FIG. 3. This would mean a 25% increase in power rather than the 8% mentioned hereinabove. This is a design tradeoff since there is an inevitable compromise between having a sensitive response and having unwanted trips.

The IC101 (FIG. 3) may be an L6561 Power Factor Corrector IC (by ST Microelectronics, of Italy, or other suitable devices. In the L6561:

Pin #1 (INV) is the PFC IC's internal differential magnified input port, and it can set the APFC's (Active Power Factor Correction) output voltage Vdc and APFC constant compensation.

Pin #2 (COMP) is the PFC IC's internal differential magnified output port, and it provides constant compensation with pin #1.

Pin #3 (MULT) is the PFC IC's internal multiplier input port. Its purpose is tracking input current, and therefore raise the ballast input power factor and function.

Pin #4 (CS) is the PFC IC's main circuit current checking input port.

Pin #5 (ZCD) is the PFC IC's zero cross checking input port. When pin #5 voltage is zero, the PFC IC's stops working.

Pin #6 (GND) is the PFC IC's power ground.

Pin #7 (GD) is the PFC IC's drive output port.

Pin #8 (Vcc) is the PFC IC's DC voltage input port.

The L6561 Power Factor Corrector is an IC intended for controlling PFC pre-regulators.

It is noted that the sensing and control technique described herein can be used with APFC controlled circuits other than the illustrative APFC circuit shown in FIG. 3. For example, it can be used with flyback circuits, continuous conduction mode circuits and buck boost circuits with suitable modifications. It can be used to operate the shut down pins of an output control chip such as the L6574. Instead of pulling down a pin of the L6561, it can be used to operate a crowbar circuit to shut down a self-oscillating inverter, for example. It could also be used to provide end of life shutdown or protection, and to protect against faults involving a high power condition, and the technique can be applied to compact fluorescent lamps and HID lamps as well as linear fluorescent lamps. Additionally, the output inverter can be series resonant, parallel resonant, series parallel resonant, class E or any of the previously described electronic ballast architectures.

It is also noted that instant start ballasts normally have high compliance voltages forcing the lamp current, and so have the capacity to cause external arcing. However, it should be understood that the techniques disclosed herein will work in a non-boosted ballast or a charge pump boost ballast, or a valley fill boost ballast by turning off the output circuit by appropriate means. The techniques can be used also for program start and rapid start electronic ballasts, and whether the output lamps are series connected or parallel connected.

Having thus described several exemplary implementations, it will be apparent that various alterations and modifications can be made without departing from the concepts discussed herein. Such alterations and modifications, though not expressly described above, are nonetheless intended and implied to be within the spirit and scope of the inventions. Accordingly, the foregoing description is intended to be illustrative only.

The invention claimed is:

1. A ballast circuit comprising an input circuit, a boost circuit coupled to the input circuit, an inverter circuit having an input and an output for driving a load, and a sensing circuit coupled to the inverter circuit input through a control circuit and wherein the sensing circuit includes an output coupled through the control circuit by way of a high impedance input node of the control circuit and to the boost circuit for changing the boost circuit when an electrical signal on the input to the inverter circuit changes a selected amount.

2. The circuit of claim 1 wherein the boost circuit is a power factor correction circuit.

3. The circuit of claim 1 wherein the inverter circuit is configured to have the characteristics of at least one of a parallel resonant circuit, series resonant circuit, and a push-pull circuit.

4. The circuit of claim 1 wherein the sensing circuit is coupled to a power line between the input circuit and the inverter circuit.

5. The circuit of claim 1 wherein the sensing circuit is configured to sense a characteristic of a current being input to the inverter circuit.

6. The circuit of claim 5 wherein the sensing circuit is configured to sense a magnitude of current being input to the inverter circuit.

7. The circuit of claim 6 wherein the sensing circuit includes a current sensing resistor.

8. The circuit of claim 7 further including a delay device for delaying when the current sensing resistor senses the current.

9. The circuit of claim 8 further including a circuit compensation device.

10. The circuit of claim 9 wherein the circuit compensation device is a temperature compensation device.

11. The ballast circuit of claim 1 wherein the sensing circuit includes a transistor between the high impedance input and a low impedance resistor.

12. The ballast circuit of claim 11 wherein the sensing circuit includes a current carrying resistor coupled to a base of the transistor.

13. The ballast circuit of claim 12 wherein the transistor has a collector-emitter saturation voltage less than 0.3 V.

14. The ballast circuit of claim 1 wherein the high impedance input for the control circuit is a zero crossing detector.

15. A ballast circuit comprising an AC input, an inverter circuit having an input for receiving an electric current and having an output circuit configured to be coupled to a load, a boost circuit between the AC input and the inverter circuit, and a sensing circuit for sensing a characteristic of the electric current received at the input of the inverter circuit and configured to apply a control signal to the boost circuit through a high impedance input node of a control circuit when the characteristic of the electric current received at the input of the inverter circuit becomes a predetermined characteristic.

16. The circuit of claim 15 wherein the sensing circuit is coupled to a main power line to the inverter.

17. The circuit of claim 16 wherein the sensing circuit includes a resistor coupled in series with the main power line.

18. The circuit of claim 17 wherein the sensing circuit further includes a delay device.

19. The circuit of claim 18 wherein the delay device is a capacitor coupled in parallel with the resistor.

20. The circuit of claim 18 wherein the sensing circuit further includes a transistor.

21. The circuit of claim 18 wherein the sensing circuit further includes a temperature compensation device.

22. The circuit of claim 15 wherein the boost circuit includes a power factor correction control circuit.

23. The circuit of claim 22 wherein the sensing circuit is coupled to an input to the power factor correction control circuit.

24. The circuit of claim 23 wherein the input is a zero crossing detection input.

25. A ballast circuit comprising an input circuit, a boost circuit coupled to the input circuit, an inverter circuit having an input and an output for driving a load, a boost circuit controller having a high impedance input, and a sensing circuit coupled to the inverter circuit input and having an output coupled to the high impedance input wherein the sensing circuit applies a signal to the boost circuit controller high impedance input when a signal on the input to the inverter circuit changes a selected amount.

26. The ballast circuit of claim 25 wherein the sensing circuit includes a transistor and a low impedance resistor coupled to the transistor.

27. The ballast circuit of claim 25 wherein the high impedance input is a zero crossing detector.

* * * * *